US005503115A

United States Patent [19]

Franzke et al.

[11] Patent Number: 5,503,115

[45] Date of Patent: Apr. 2, 1996

[54] STEAM GENERATOR WITH A WATER LANCE SPRAYER FOR CLEANING A SURFACE OF A HEAT EXHANGER OF THE STEAM GENERATOR, AND A WATER LANCE SPRAYER IN A STEAM GENERATOR

[75] Inventors: Lothar Franzke; Frank-Dieter Kahle, both of Cottbus; Reinhard Sommer, Calau; Wilfried Boden, Stradow, all of Germany

[73] Assignee: Veag Vereinigte Energiewerke Aktiengesellschaft, Berlin, Germany

[21] Appl. No.: 275,823

[22] Filed: Jun. 17, 1994

Related U.S. Application Data

[63] Continuation-in-part of PCT/DE92/01050, Dec. 9, 1992.

[30] Foreign Application Priority Data

Dec. 18, 1991 [DE] Germany ..... 41 42 448.4
Nov. 17, 1992 [DE] Germany ..... 42 39 410.4

[51] Int. Cl.[6] ..... F22B 37/52; F28G 9/00

[52] U.S. Cl. ..... 122/390; 15/316.1; 134/167 R

[58] Field of Search ..... 122/390, 405, 122/392, 388, 381, 383, 384, 380; 110/170; 15/316.1, 362, 104.11; 134/144, 151, 152, 167 R

[56] References Cited

U.S. PATENT DOCUMENTS

| | | | |
|---|---|---|---|
| 1,550,943 | 8/1925 | Baker | 122/390 |
| 3,354,490 | 11/1967 | Masters et al. | 15/104.1 |
| 5,195,548 | 3/1993 | Roger | 134/167 R |
| 5,337,441 | 8/1994 | Miyamoto et al. | 122/392 X |

FOREIGN PATENT DOCUMENTS

| | | |
|---|---|---|
| 1362718 | 4/1964 | France . |
| 1751511 | 6/1968 | Germany . |
| 145476 | 12/1980 | Germany . |
| 235102 | 4/1986 | Germany . |
| 0272186 | 11/1927 | United Kingdom . |

*Primary Examiner*—Denise L. Gromada
*Assistant Examiner*—Susanne C. Tinker
*Attorney, Agent, or Firm*—Nils H. Ljungman & Associates

[57] ABSTRACT

A steam generator with a water lance sprayer for cleaning a surface of a heat exchangers of the steam generator, and more particularly combustion-chamber heat-transfer surfaces in steam boilers, can have an outlet opening swivel-type supported in the wall of the steam generator and its rear parts swivel-type suspended. Such a lance blower is provided with a polydirectional movability in a plane at the outlet opening of the water lance blower without contamination to ensure that the jet meeting the opposite boiler wall describes an exactly defined course. This is done by providing a flange at the outlet opening of the blowpipe, which flange can be attached to a segment of a cardan joint with the cardan joint being fastened in the combustion-chamber wall. The rear part of the blowpipe is preferably arranged in a guide, which guide is vertically shiftable on a vertical spindle, with the vertical spindle being shiftable, at the top and at the bottom thereof, horizontally on a horizontal spindle, and with the guide being formed by a housing that is non-rotatably positioned on the vertical spindle. The guide preferably carries a fork-shaped accommodation containing a cardan-shaped cage which internally is designed as a sleeve for holding the blowpipe in an axially shiftable manner.

17 Claims, 11 Drawing Sheets

STEAM GENERATOR WITH A WATER LANCE SPRAYER FOR CLEANING A SURFACE OF A HEAT EXHANGER OF THE STEAM GENERATOR, AND A WATER LANCE SPRAYER IN A STEAM GENERATOR

CONTINUING APPLICATION DATA

This application is a continuation-in-part application of International Application No. PCT/DE92/01050, filed on Dec. 9, 1992, which claims priority from Federal Republic of Germany Patent Application No, P 42 39 410.4, filed on Nov. 17, 1992, and Federal Republic of Germany Patent Application No, P 41 42 448, filed on Dec. 18, 1991. International Application No. PCT/DE92/01050, was pending as of the filing date of this application.

BACKGROUND OF THE INVENTION

1. Field of the Invention

This invention generally relates to a steam generator with a water lance sprayer, or blower, for cleaning heat exchange surfaces, and more particularly for cleaning a combustion-chamber heat-transfer surface in a steam boiler. Such a water lance blower can have an outlet opening swivellably supported in a wall of the steam generator, with the rear parts thereof swivellably suspended for movement at the mounting wall.

2. Background Information

The cleaning of the combustion chambers of steam boilers having a high capacity, during operation, can be achieved, among other methods, with the aid of water lance blowers which can be mounted on a first wall of the steam boiler to throw a concise water jet, through the combustion chamber, and against the opposite wall. The contaminations of soot, slag and ash can then be peeled off due to the kinetic energy of the water jet hitting the surfaces, and also as a result of the thermal shock caused when the cooler water hits the heated surfaces of the exchanger.

To enable such a cleaning, the blowpipe, provided with a concentric spray nozzle, has been linked via a roller guide, with a drive for carrying out superimposed movements of the blow pipe, in an articulated way. For cleaning purposes, the water lance blower can be guided through a wall of the combustion chamber at an opened hatch, or the blowpipe can be entered into the combustion chamber through a piece of pipe supported in the hatch. Then, subsequent to the cyclic cleaning process, the water lance blower will typically be swung out or moved backward linearly, to remove the pipe from the combustion chamber, and thereby protect the blowing nozzle thermally and mechanically. Such a procedure, however, requires expensive equipment which is susceptible to trouble and, apart from that, renders it very difficult to automate the cleaning process. Moreover, with such solutions, multiple deflections, or bends, are needed in the water supply system, which deflections can cause high losses of water pressure ejected from the nozzles.

For avoiding the leakage of air into the steam boiler, and also for preventing contamination from exiting out of the steam boiler, the pipe passage through the combustion-chamber wall must preferably be as tight as possible.

For sealing longitudinally shiftable and rotatable jet pipes, it is known that the jet pipe can be passed through a stuffing box which is screwed to the face plate of the soot blower, as is described by Federal Republic of Germany Patent No. 17 51 511. This type of solution is essentially applicable, however, only to rigid water lance blowers.

For swivel-type water lance blowers, it is known that the blower head can be supported in a hatch of the combustion-chamber wall by means of a ball joint as is disclosed by German Democratic Republic Patent No. 145 476. With this solution, it is however disadvantageous that the hatch in the combustion-chamber wall must be divided horizontally and inserted into a machined spheroidal bore of a ball joint. Due to the entry of impurities into the sliding surfaces of the ball joint, the sliding surfaces tend to wear very quickly, so that the service life will typically be very short and the sealing and swivel function cannot be ensured any longer due to the fact that the ball joint gets jammed.

For exchanging the ball joint, the entire hatch must be removed. Thus, the removal of the hatch would provide an opening in the chamber surfaces, and the steam boiler essentially has to be put out of service for this purpose, so that contaminants do not leak out of the combustion chamber.

With another known water lance blower, the blowpipe is not required to be moved axially any longer, the diameter of the pipe passage through the hatch is reduced, and a self-cleaning effect is achieved between the sliding parts of the pipe passage. Such an arrangement is shown by German Democratic Republic Patent No. 235 102.

This is constructively achieved by a blow-through cylinder which is rigidly flange-mounted to the front of the blowing nozzle, and the outlet opening of the blowing nozzle is introduced into the blow-through cylinder. The blow-through cylinder is rigidly fastened in the ball joint, formed by a ball segment, and, in its free part, is slotted or provided with bores.

With this type of water lance blower, it is disadvantageous that the self-cleaning effect of the ball joint have not been found to be sufficient. The partition of the joint proves to be disadvantageous with regard to the heat admission due to the different expansions of both the halves. In spite of the design of a swivel-type roller guide, even with this solution, in the combustion chamber, no exact rectangular blowing pattern can be achieved on the opposite combustion-chamber wall by the ejected stream.

OBJECT OF THE INVENTION

The present invention is based on the task of designing a water lance blower, whose outlet opening can be swivellably supported in the wall of the steam boiler and whose rear end can be swivellably suspended in such a way that an all-around movability in a plane is ensured at the outlet opening, without contamination, and that the ejected jet describes an essentially exactly defined course at the opposite boiler wall.

SUMMARY OF THE INVENTION

According to the present invention, this object can be achieved by providing the blowpipe assembly with a flange which can be disposed at the outlet opening of the blowpipe, which flange can be attached to a segment of a cardan, or universal joint, while the cardan joint can be fastened in the combustion-chamber wall. The rear part of the blowpipe can preferably be arranged in a guide, which guide can preferably be vertically shiftable on a vertical spindle. In turn, the vertical spindle, at the top and bottom thereof, can preferably be shiftable horizontally on horizontal spindles, The guide can preferably be formed from a housing that can be non-rotatably located on the vertical spindle and, on the side thereof, can carry a fork-shaped accommodation in which a cardan-shaped cage is arranged. The cardan-shaped cage can be internally designed as a sleeve which can accept the blowpipe therein in an axially shiftable way.

Furthermore, the vertical spindle can preferably be enclosed by a stationary protective pipe, or sleeve, with a longitudinal groove. A threaded nut with a fitting key can then be arranged on the vertical spindle with the fitting key being guided in the longitudinal groove and projecting from this groove. The key can be configured to hold a bushing, on which bushing the housing can be located. The vertical spindle can be driven by a geared motor, which geared motor can turn the vertical spindle. Thus, since the threaded nut can preferably be held in a non-rotatable manner about the vertical spindle, the nut will move upwardly and downwardly depending on the direction of rotation of the spindle.

The housing and the fork-shaped accommodation can preferably advantageously be made of one piece, and the fitting key can preferably be T-shaped. The flange of the key can then preferably be fastened to the housing from the outside, and the shaft can preferably pass through the housing into engagement with the threaded nut. The vertical and the horizontal spindles are enclosed by a bellow or a spiral protective spring.

Both the horizontal spindles can preferably be supported at least adjacent the ends thereof in a front box, or housing, and in a rear box, or housing. The upper spindle can preferably be driven by a geared drive motor, and the lower spindle can be driven in conjunction with the upper spindle by means of a chain located in the rear box and engaged between both horizontal spindles, i.e. about toothed gears disposed about the spindles.

Alternatively, the lower horizontal spindle could be driven by a drive motor, if desired, and the upper spindle could be driven by a chain engaged between the two spindles, or it might also be conceivable to drive both horizontal spindles by separate motors which can be driven in synchronization with one another.

In summary, one aspect of the invention resides broadly in a steam generator with a spray lance for cleaning contaminants off a surface of a heat exchange member of the steam generator, the steam generator comprising: a combustion chamber for burning fuel to generate heat; fuel supply apparatus for supplying fuel to the combustion chamber; a first chamber adjacent the combustion chamber for receiving heat generated by combustion from the combustion chamber; a heat recovery chamber for containing water to be heated by heat generated by combustion; the heat exchange member being disposed between the first chamber and the heat recovery chamber to transfer heat generated by combustion to water contained in the heat recovery chamber; the heat exchange member having a first surface in the first chamber and a second surface in the heat recovery chamber and the heat exchange member being configured for transferring heat from the first surface to the second surface; and apparatus for removing contaminants from the first heat exchange surface, the apparatus for removing comprising: the spray lance, the spray lance having a first end disposed towards the first surface for ejecting fluid under pressure against the first surface, and a second end opposite the first end, the spray lance defining an axial direction between the first and second ends; apparatus for pivotably mounting the spray lance in a third surface in the first chamber, the third surface being substantially opposite the first surface; apparatus for supplying fluid under pressure to the spray lance; apparatus for pivoting the first end of the spray lance relative to the second end of the spray lance to move the first end of the spray lance along at least: a first substantially linear path; and a second substantially linear path disposed angularly to the first path to define a plane of movement of the first and second paths, the plane of movement being disposed angularly with respect to the axial direction of the spray lance.

Another aspect of the invention resides broadly in apparatus for washing contaminants off at least a first surface of a heat exchange member in a steam generator, the steam generator having a combustion chamber for burning fuel to generate heat; a first chamber adjacent the combustion chamber for receiving heat generated by combustion from the combustion chamber, a heat recovery chamber for containing water to be heated by heat generated by combustion, the heat exchange member being disposed between the first chamber and the heat recovery chamber, and the first surface of the heat exchange member being disposed in the first chamber, the apparatus for washing comprising: nozzle apparatus for ejecting fluid under pressure against the first surface, the nozzle apparatus having a first end for being disposed toward the first surface of the heat exchange member and a second end disposed opposite the first end, the nozzle apparatus defining an axial direction between the first and second ends; apparatus for pivotably mounting the nozzle apparatus in the first chamber at a position substantially opposite the first surface; apparatus for supplying fluid under pressure to the nozzle apparatus; apparatus for pivoting the first end of the nozzle apparatus relative to the second end of the nozzle apparatus to move the first end of the nozzle apparatus along at least: a first substantially linear path; and a second substantially linear path disposed angularly to the first path to define a plane of movement of the first and second paths, the plane of movement being disposed angularly with respect to the axial direction of the nozzle apparatus.

BRIEF DESCRIPTION OF THE DRAWINGS

The embodiments of the present invention are explained in greater detail herebelow, including an operational example, with reference to the accompanying drawings, in which.

DESCRIPTION OF THE PREFERRED EMBODIMENTS

Figure 1:
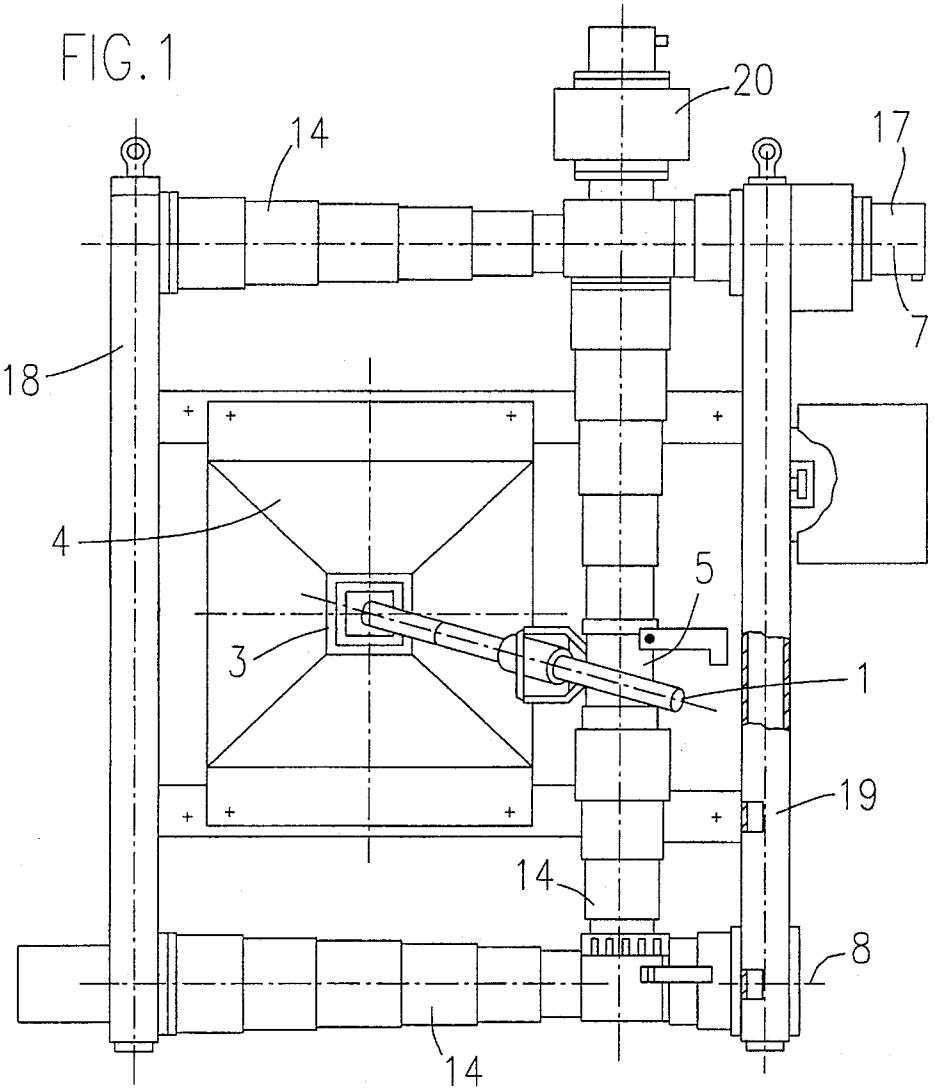
FIG. 1 shows a front view of the water lance blower.
Figure 1A:
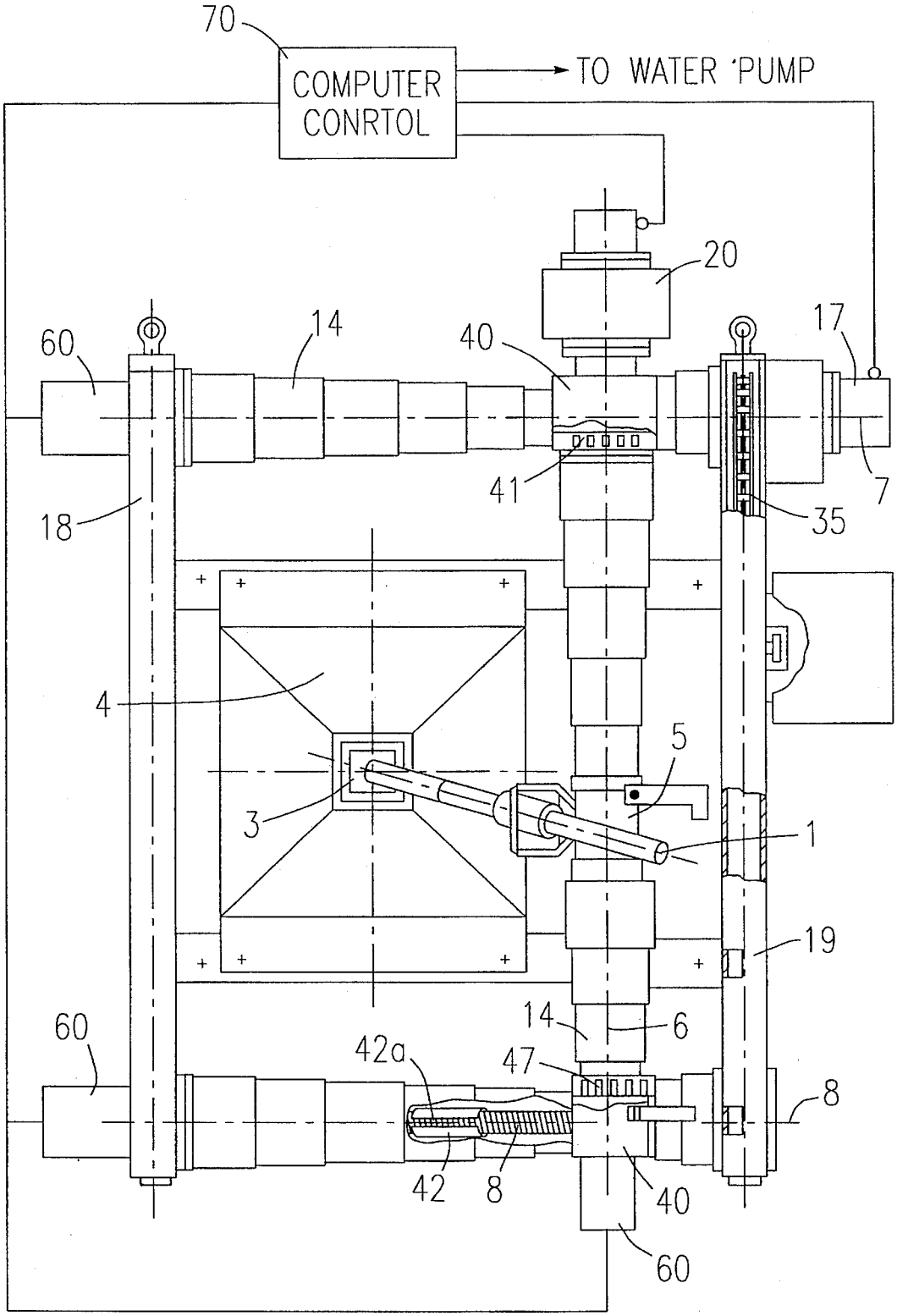
FIG. 1*a* shows a more detailed view of the water lance blower of FIG. 1.
Figure 1B:
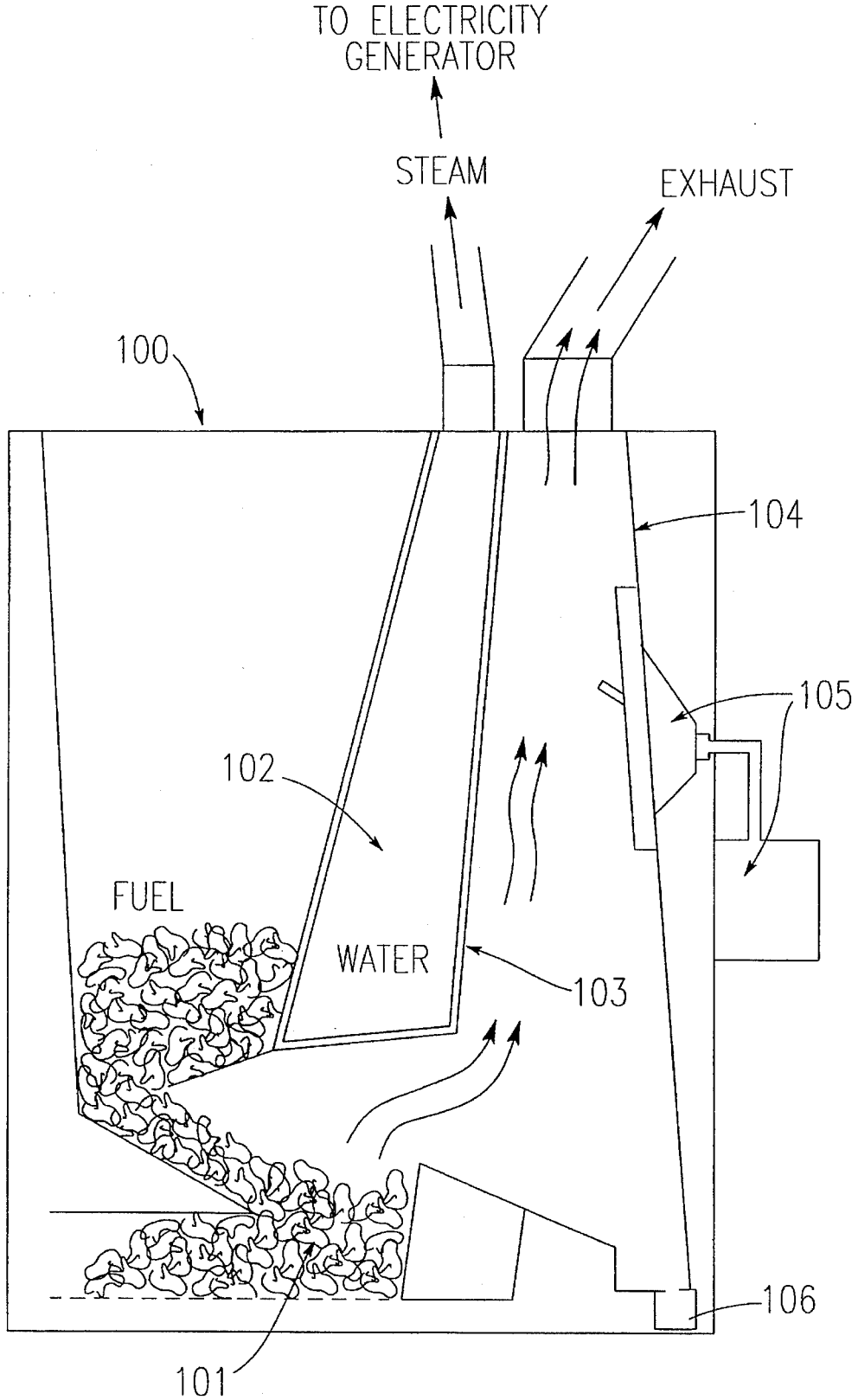
FIG. 1*b* shows a partial view of a steam boiler with a water lance blower for cleaning a heat exchange surface.

A general type of heating apparatus which heats via combustion, such as the simplified representation of a steam boiler 100, shown in FIG. 1*b*, will typically have a combustion chamber 101 which is separated from a heat recovery area 102 by a heat exchange surface 103. In general, a heat recovery area 102 will be flushed through with a fluid, such as liquid or air, to heat the fluid with the heat generated in the combustion chamber 101. In the depicted embodiment, water is used to generate steam. The heated fluid can then be conducted to remote locations for area heating, etc., or in the case of the depicted embodiment, to an electric generator for generating electricity. The heat exchange surface 103 in essence, keeps the combustion pollutants, such as soot, ash, carbon monoxide, etc., from entering into the heated fluid, while also receiving the heat generated by the combustion, to thereby transfer the heat to the fluid on the other side thereof.

During the combustion process, soot and ash can tend to form a layer of contamination on the surface 103, and this layer of contamination can then reduce the effectiveness of the heat exchange which occurs at the surface 103. Thus, cleaning apparatus, such as the water lance sprayer, blower, or nozzle 105, can be provided at another surface 104 of the heating apparatus, which surface can preferably be a non-heat exchange surface, to force water, under high pressure, against the heat exchange surface 103 to remove any deposits which might have formed thereon. The water from the the lance blower 105 and any contaminants washed off of surface 103 can be drained from the boiler 100 by means of a water collection and drain area 106. Such a water lance blower is discussed in further detail herebelow in accordance with the embodiments of the present invention. It should be understood that the components as discussed hereinbelow can be used in conjunction with the components as discussed hereabove for a general heating apparatus.

Figure 2:
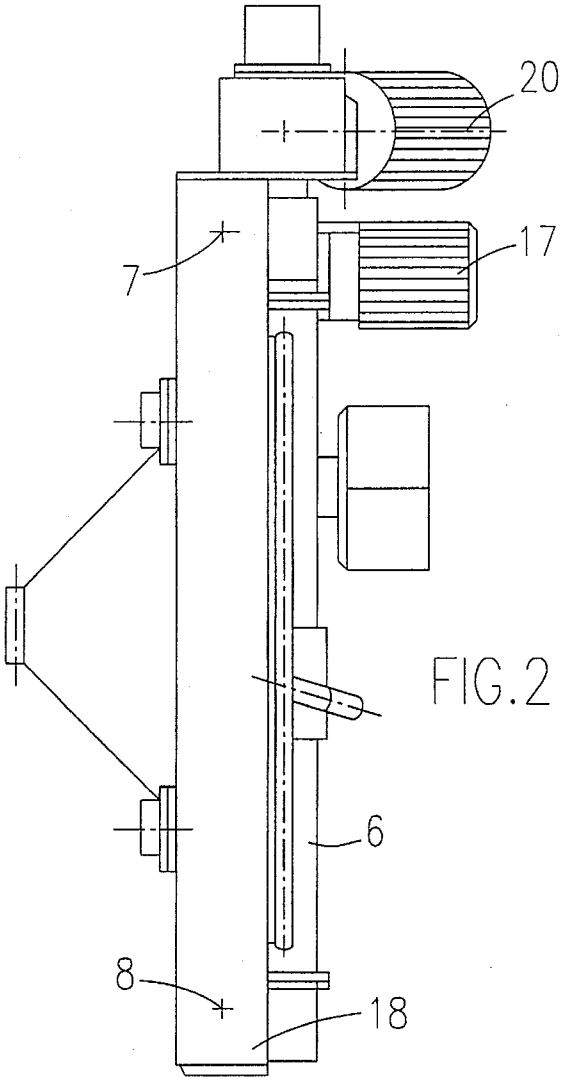
FIG. 2 shows a side view in accordance with the embodiment depicted in FIG. 1.

In at least one preferred embodiment of the present invention, as depicted in FIGS. 1 and 2, the water lance blower can mainly comprise a blowpipe 1, a cardan joint 3, which could also be termed a universal joint, a guide 5, a vertical spindle 6 and two horizontal spindles 7, 8. The spindles 6, 7 and 8 can essentially be configured as screws having a spirally disposed thread thereabout. In the depicted embodiment, the blowpipe 1, is, with its outlet opening, preferably evenly located in a flange which is attached to a segment of the cardan joint 3. In other words, a first end of the blowpipe 1, the non-discharge end, can be attached to the cardan joint 3. The cardan joint 3 can be fastened in a hatch of the combustion-chamber wall 4, such as, for example by bolts, or another type of fastening device. The rear part of the blowpipe 1, or the discharge end, can preferably be located in the guide 5 which can be disposed in conjunction with the vertical spindle 6 in a vertically shiftable manner to be moved in a vertical direction by means of the spindle 6. In one possible configuration of the present invention, the blow pipe could possibly be configured to be withdrawn out of the heating appliance when not in use.

The vertical spindle 6 can preferably be supported at the top thereof on the horizontal spindle 7 and at the bottom thereof on the horizontal spindle 8. The vertical spindle 6 can preferably be mounted to the spindles 7 and 8 in a horizontally shiftable manner, so that the spindle 6 can be moved on the spindles 7 and 8 in a horizontal direction.

It should also be understood that the spindle 6 could be a horizontal spindle, while the spindles 7 and 8 could be vertical spindles, and that essentially any other orientation of the spindles is also possible, i.e., all of the spindles could essentially be oriented diagonally with respect to the horizontal and vertical, depending on the configuration of the surface to be cleaned.

Figure 3:
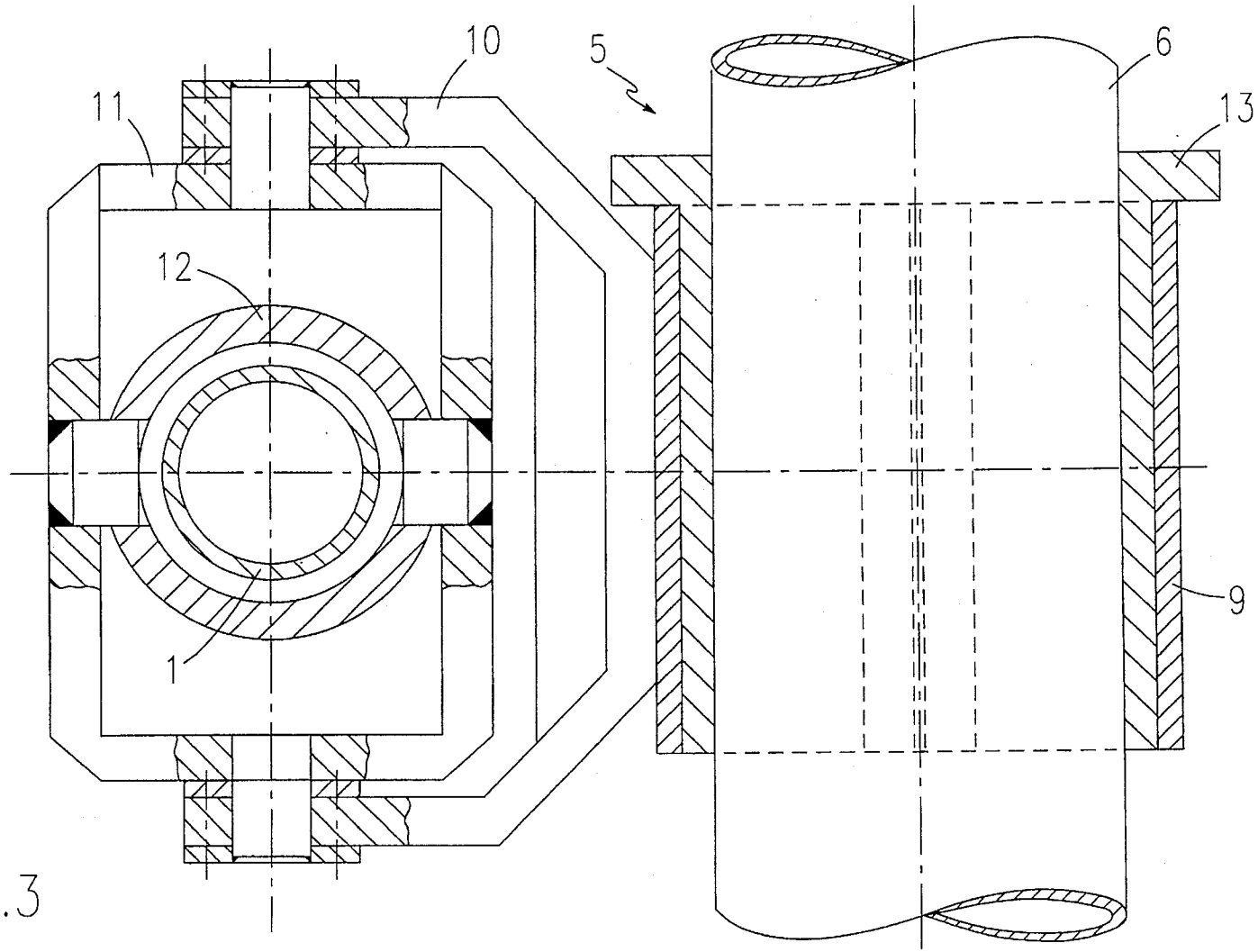
FIG. 3 shows one embodiment of a guide for the blowpipe.

For movement of the guide 5 on the vertical spindle 6, the vertical spindle 6 can be driven by some sort of drive, or geared motor 20. In essence, drive arrangements for rotating spindles are well known, and will therefore not be discussed in any further detail herein. As shown in FIG. 3, the guide 5 can preferably include a housing 9 which can be located in a non-rotatable manner on the vertical spindle 6. The housing 9 can preferably carry, on its side, or laterally, a fork-shaped accommodation 10, in which accommodation 10 a cardan-shaped cage 11 can be positioned. Such a cage 11 could essentially be rectangular in shape. The cage 11, in its interior portion, can be designed as a sleeve 12 which can hold the blowpipe 1 therein, in an axially shiftable manner. In one possible configuration of the present invention, the accommodation 10 can preferably be a separate component from the housing 9, and can be fastened thereto, for example, by welding, etc.

Figure 3A:
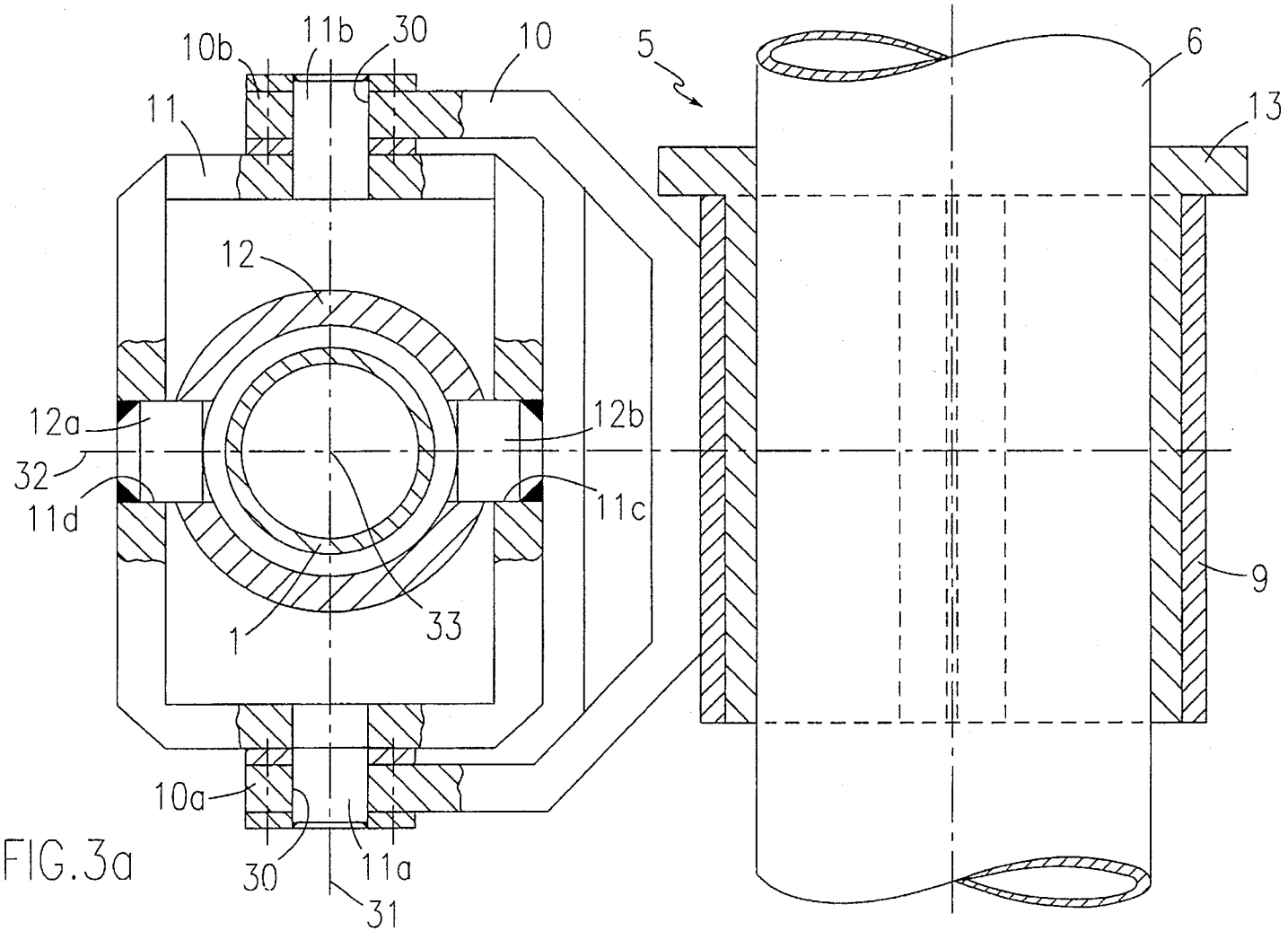
FIG. 3*a* shows an embodiment similar to that of FIG. 3, but more detailed.

In other words, as shown in FIG. 3*a*, in one possible embodiment of the invention, the ends 10*a* and 10*b* of the accommodation 10 can have orifices 30 formed therein. The cage 11 can then be fitted with pivots 11*a* and 11*b*, at a first set of opposite sides thereof, which pivots 11*a* and 11*b* can fit into the orifices 10*a* and 10*b* to allow for a pivoting of the cage 11 about a first axis 31. The other set of opposite sides of the cage 11, can also be provided with orifices 11*c* and 11*d*, while the sleeve 12 can be provided with pivots 12*a* and 12*b* for being disposed in the the orifices 11c and 11d. Thus, the sleeve 12 can be configured to be pivoted about a second axis 32. By means of the dual sets of pivots, 11*a*, 11*b*, 12*a* and 12*b*, the sleeve 12 can be pivoted to essentially any angle within the limits defined by the dimensions of the cage 11, the sleeve 12, and the accommodation 10.

Figure 4:
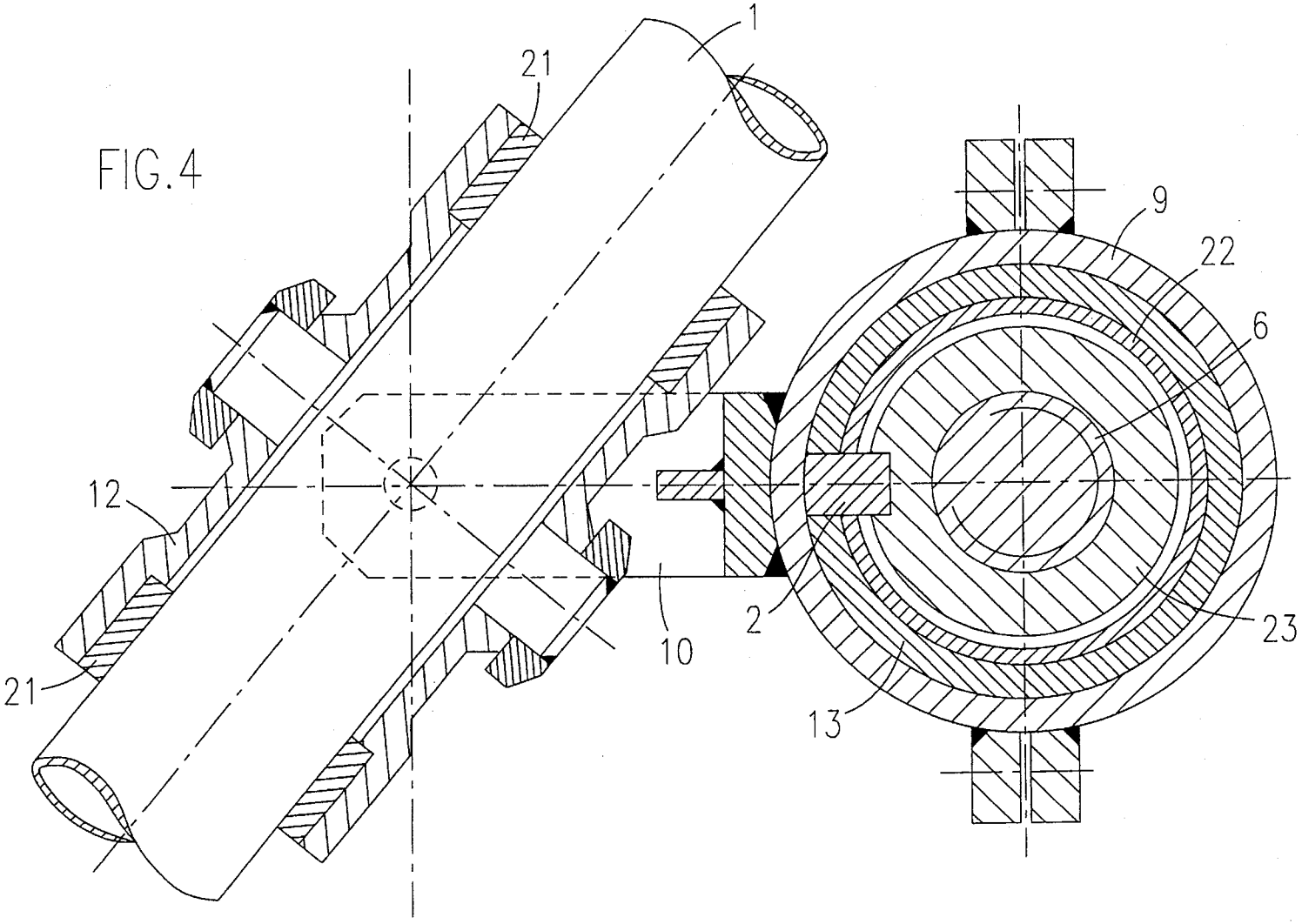
FIG. 4 shows a section through the guide according to FIG. 3.
Figure 4A:
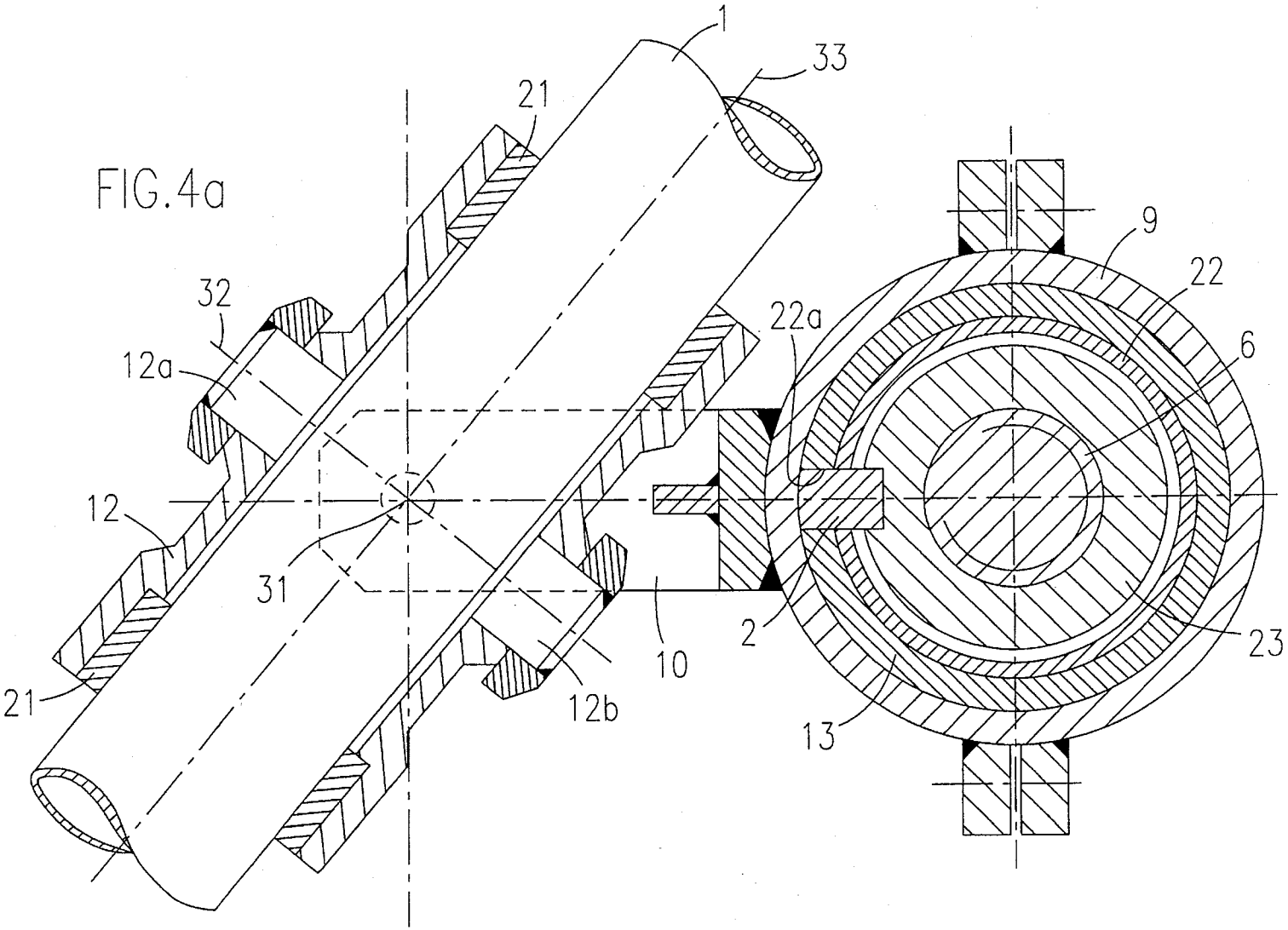
FIG. 4*a* shows an embodiment similar to that of FIG. 4, but more detailed.

As shown in FIGS. 4 and 4*a*, the sleeve 12 can be provided with slide bushings 21 at both ends thereof for allowing an axial, or sliding movement of the pipe 1 in the direction as defined by axis 33.

The vertical spindle 6 can preferably be enclosed by a stationary protective pipe 22 which can be provided with a longitudinal groove 22*a*. A threaded nut 23 with a fitting key 2 can be arranged on the spindle 6, i.e., can be threaded onto the spindle 6 under the protective pipe 22. The fitting key 2 can preferably be guided in the longitudinal groove 22*a*, to project from the groove 22*a*, and preferably engage a bushing 13, on which bushing the housing 9 can be placed. For covering the longitudinal groove in the protective pipe 22 and for protecting the protective pipe 22, the vertical spindle 6 can preferably be enclosed by a bellow or by a spiral protective spring 14 as shown in FIG. 1. Thus, since the pipe 22 will preferably be maintained stationary, with the key 2 extending through the stationary slot 22*a*, a rotation of the spindle 6 by a drive motor 20 will essentially move the nut in a direction along the spindle 6 to thereby raise or lower the guide 5.

The horizontal spindles 7, 8 can also preferably be enclosed by a bellow or by a spiral protective spring 14. As shown in FIGS. 1 and 1*a*, both the horizontal spindles 7, 8 can be, at the ends thereof, supported in a box, or enclosure 18, 19. The upper horizontal spindle 7 can be driven by a geared motor 17, and via a transmission element, or chain 35 (see FIG. 1*a*), the lower spindle 8 can be connected with the upper spindle 7 in the rear box 19 for movement substantially simultaneously with, and in synchronization with, the upper spindle 7. Alternatively, the lower spindle 8 could be driven by a motor and the upper spindle could be driven by means of a transmission element. In addition, it might also be conceivable that both spindles could be driven by separate motors, which were driven in synchronization with one another.

Figure 2A:
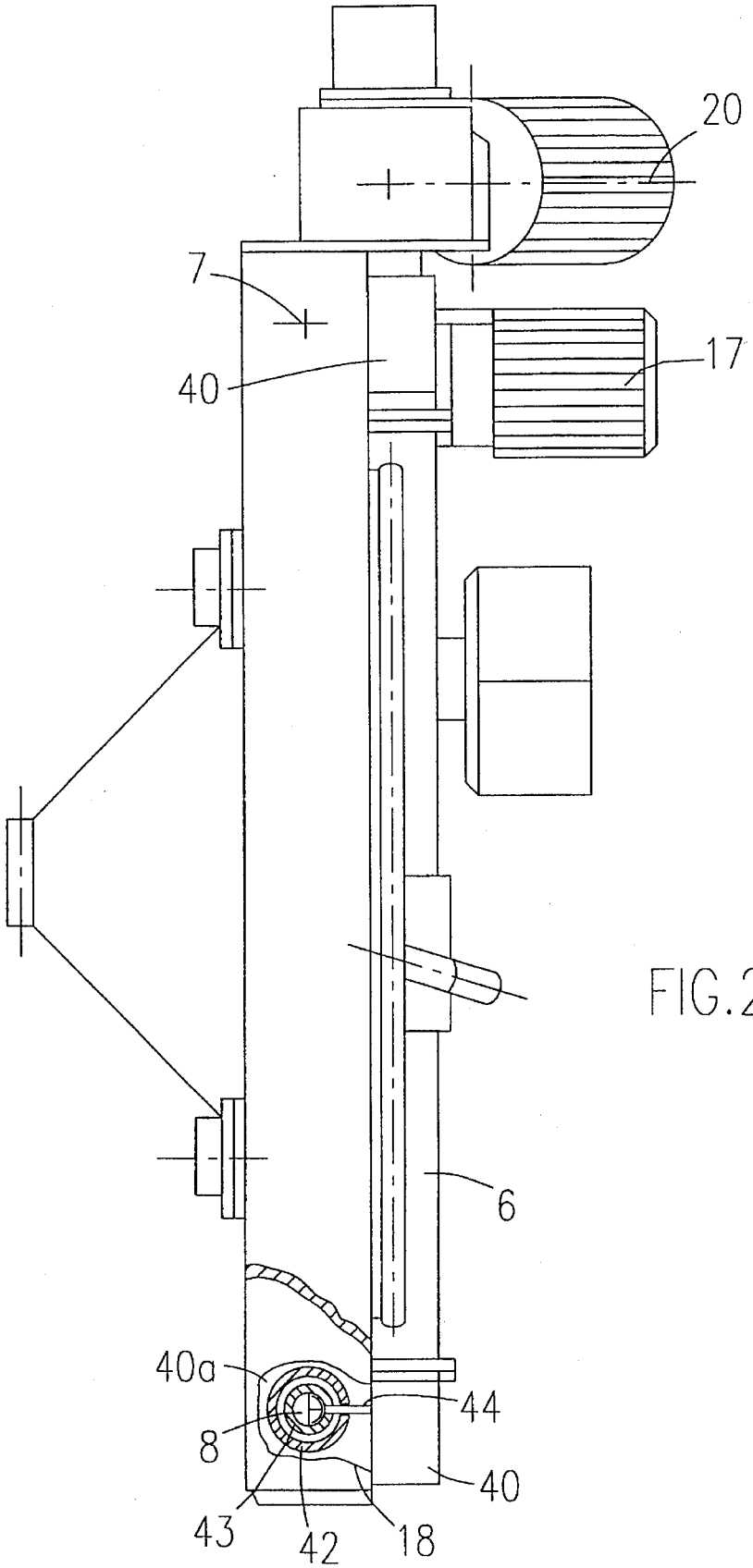
FIG. 2*a* shows a more detailed view of the embodiment of FIG. 2.

For movement of the spindle 6, on the spindles 7, 8, the spindle 6 can, in at least one embodiment of the invention, preferably be guided by an arrangement similar to that described above for movement of the guide 5 on the spindle 6. In other words, as shown in FIGS. 1*a* and 2*a*, the spindle 6 can be provided with a housing 40 adjacent each end thereof. The housings 40 can each be provided with roller bearings 41 for allowing rotation of the spindle 6 therein. The spindles 7 and 8 can each be provided with a stationary protective sleeve 42 disposed thereabout. The housings 40 can preferably also have a guide member 40*a* disposed about the sleeve 42 for guiding the housing 40 along the spindles 7 and 8. The sleeves 42 can have a longitudinal slot 42*a* therein. The spindles 7 and 8 can each preferably have a nut 43 threaded thereon, while each nut 43 can be connected to a key member 44 which projects through the slot 42*a* of the corresponding sleeve 42. The key member 44 can then be fastened at its other end to a corresponding housing 40 or housing guide 40*a*, so that upon rotation of the spindles 7 and 8, since the key member 44 and nut 43 are essentially held in a non-rotating manner on the spindles 7 and 8 by means of the sleeves 42, the rotation of the spindles 7 and 8 will cause the housings 40 to move longitudinally along the spindles 7 and 8.

Figure 5:
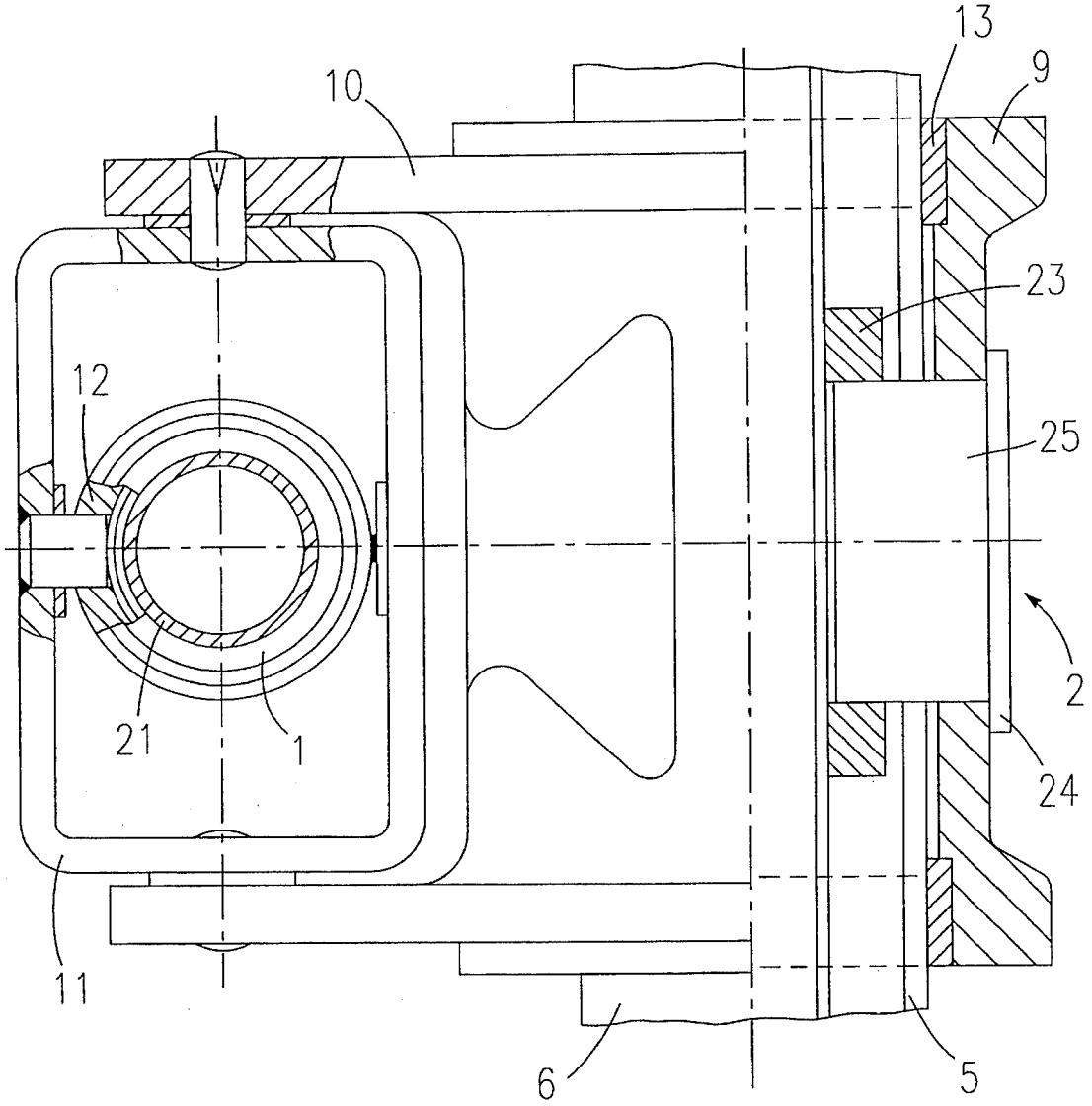
FIG. 5 depicts an alternative version of a guide for the blowpipe in a partial section.
Figure 6:
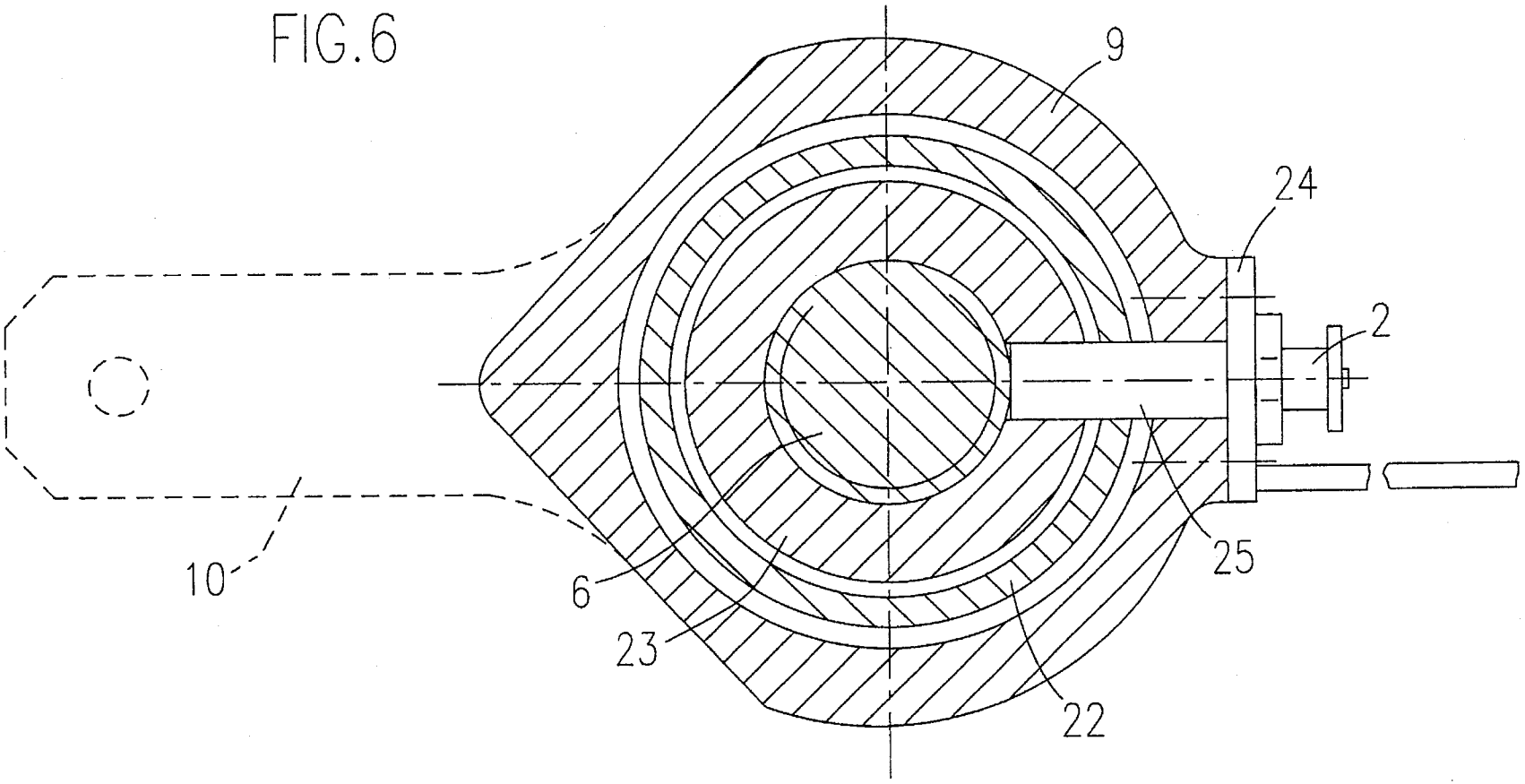
FIG. 6 shows a section through the housing with the fitting key according to the embodiment of FIG. 5.

With another version for guiding the blow pipe 1, according to FIGS. 5 and 6, the housing 9 and the accommodation 10 can advantageously be made of one piece, particularly, of a casting. FIG. 5 essentially depicts the housing 9 with a quarter section removed in the longitudinal direction of the housing 9. In this variant embodiment, the fitting key 2 can be T-shaped, and by means of its flange 24, can be firmly fastened, i.e., by screws, to the exterior of the housing 9. With the shank 25, the fitting key 2 can be passed through the housing 9 into engagement with the threaded nut 23 (see FIG. 6).

In this case, the earlier mentioned protective pipe 22 also serves as a guide for the fitting key 2, which is in essence, actuated by the threaded nut 23. The earlier mentioned bushing 13, can be, as shown in this embodiment, of two pieces, which can essentially be inserted into both ends of the housing 9. With this variant, the fitting key 2, which will generally tend to wear during the moving procedure and therefore essentially need to be exchanged after major intervals of operation, can be exchanged more easily. In essence, to remove the fitting key 2 and to exchange it with a new one, it can essentially only be necessary to loosen the screw joint holding the flange 24 to the housing 9.

One preferred mode of operation of the water lance blower can preferably be as follows:

The blowpipe 1 can preferably be swivelled by actuating the vertical spindle 6 with the aid of the geared motor 20 and by actuating the horizontal spindles 7, 8 with the aid of the geared motor 17. As a result, the guide 5, with the blowpipe 1, can carry out a meander-type movement, or multi-directional movement, with this movement being also effected by the water jet at the opposite combustion-chamber wall in a mirror-inverted way. Due to the non-rotatable housing 9, the pivot of the blowpipe 1 is essentially always located in the moving plane of the vertical spindle 6, whereby the blowpipe 1, however, can carry out all the necessary movements due to the support in the cardan-shaped cage 11, in which cage 11, the blowpipe 1 is preferably axially movable.

Thus it can essentially be ensured that, compared with the former curve-shaped movement of the known devices, as discussed above, which curve-shaped movements can result in an insufficient straight-lined contour at the opposite combustion-chamber wall, a continuously straight-lined movement can be achieved to essentially guarantee a straight-lined contour. This straight-line contour can be especially advantageous for use on heat exchange surfaces which have a rectangular area, to thereby enable cleaning of the distant corners.

Also, because of the configuration provided by the present invention, a certain section at the opposite combustion-chamber wall, e.g., a burner opening or a flue-gas back absorption, can be by-passed during cleaning, in a controlled manner.

By means of the solution of the present invention, which essentially appears to provide an exact straight-lined guidance of the spraying jet, for the first time, the blowing pattern can be mathematically determined for the most different combustion-chamber surfaces to be cleaned, and can be converted into a directed moving procedure with its exact execution being facilitated as well. Thus it is not necessary to correct the blowing pattern formed practically.

The range of application of the water lance blower described in the present invention is thus increased considerably.

For movement of the blowpipe 1, the arrangement in accordance with the present invention also enables a computer controlled movement to be carried out. In essence, a computer 70, as shown in FIG. 1*a*, could be programmed to move the blowpipe 1, via the spindles 6–8, in a predetermined pattern, such as possibly the patterns depicted in FIGS. 7*a* and 7*b*, which pattern could even skip over, or move around openings 50 in the surface, as discussed above.

Figure 7B:
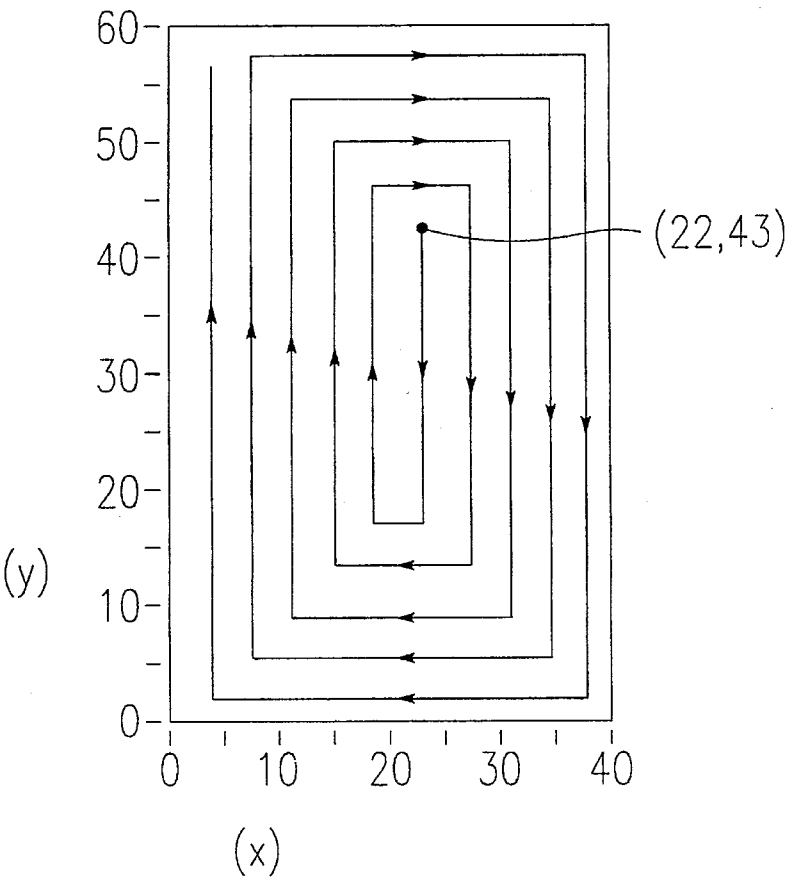
FIGS. 7*a* and 7*b* show possible spray patterns which can be provided by possible embodiments of the present invention.
Figure 7A:
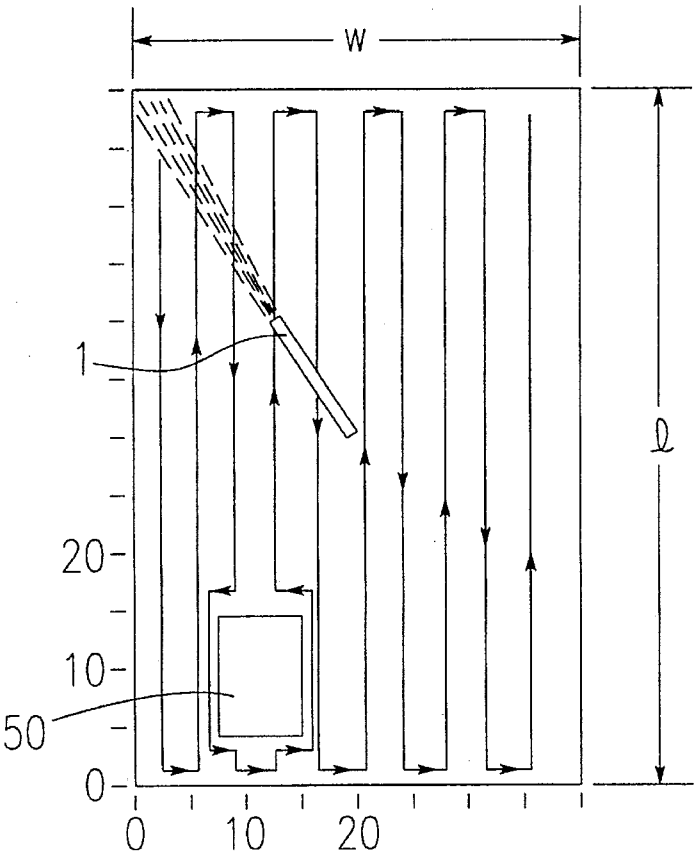

In essence, in at least one embodiment of the operation of the apparatus in accordance with the present invention, upon installation of the washing system, the overall dimensions of the surface to be washed, length (l) and width (w), could be entered into a computer control system 70, as depicted in FIG. 1*a*. The installation program might then provide a query as to what type of wash pattern is desired, i.e. an up and down vertical pattern which steps to the left or right as shown in FIG. 7*a*, or a spiral pattern as shown in FIG. 7*b*. It should be realized that other types of patterns could also be programmed, and the typical types of wash patterns that can be used would be well within the skill of the artisan.

After selection of a pattern, a starting coordinate, in terms of an (x,y) point in a cartesion coordinate grid could then also be entered. Such a grid could essentially correspond to units of measure, such as centimeters, or could essentially merely be reference numbers spaced at essentially equal intervals, for defining a precise location on a surface. As shown in FIG. 7*b*, such an (x,y) point, which could be used as a starting point, can be represented as point (22, 43). The computer system 70 could then preferably automatically determine a movement system to fit the entered dimensions, for example:

1) Start at point (22, 43);
2) rotate spindles 7, 8 to move to point (22, 17);
3) rotate spindle 6 to move to point (18, 17);
4) rotate spindles 7, 8 to move to point (18, 47);
5) rotate spindle 6 to move to point (27, 47);
6) rotate spindles 7, 8 to move to point (27, 13);

7) rotate spindle 6 to move to point (15, 13);
8) rotate spindles 7, 8 to move to point (15, 51);
9) rotate spindle 6 to move to point (30, 51);
10) etc. . . .
Z) rotate spindle 6 to move to point (5, 58)
END SPRAY The above example is meant as exemplary only, as many other configurations and movement steps would be possible depending on the configuration of the surface being cleaned.

Alternatively, if an opening, such as opening 50, was to be bypassed, the installation, or operation program could provide a query as to whether such an opening existed. If the answer to such a querey is "yes", the program could then preferably prompt for the coordinate location of such an opening. Again, using the example of FIG. 7*a*, such coordinates might be, (7, 15), (15, 15), (15, 4) and (7, 4). The computer could then operate the spindles in a manner which would avoid having the spray enter a coordinate which was defined by the outlined box, etc.

For monitoring movement of the spindles, each of the spindles could be provided with a movement sensor 60 for determining if the appropriate movement has been carried out by the spindles 6–8. Further, the sensors 60 on the spindles 7 and 8 could also provide information on whether the spindles 7 and 8 were moving in synchronization with one another, i.e. which could be useful for separate drive motors for spindles 7 and 8, or alternatively could indicate if the transmission element 35 was operating correctly.

In general, the operation of such a system in accordance with the present invention, in terms of programing, and motor control stepping would be well within the skill of the artisan, and in addition to the control and program steps as outlined above, many other control and program steps would also be usable for operation of the apparatus in accordance with the present invention.

One feature of the invention resides broadly in the water lance blower for cleaning heat exchangers, particularly so a combustion-chamber heat-transfer surface in steam boilers, its outlet opening swivel-type supported in the wall of the steam boiler and its rear parts suspended in a polydirectionally movable way the object being that a flange is provided at the outlet opening of the blowpipe 1 which is attached to a segment of a cardan joint 3 with the cardan joint 3 being fastened in the combustion-chamber wall 4, that the rear part of the blowpipe 1 is arranged in a guide 5 which is shiftable vertically on a vertical spindle 6 with the vertical spindle 6 being shiftable horizontally on a horizontal spindle 7; 8 at the top and at the bottom and with the guide 5 being formed by a housing 9 which is positioned on the vertical spindle 6 non-rotatably and carries a fork-shaped accommodation 10 containing a cardan-shaped cage 11 which internally is designed as a sleeve 12 holding the blowpipe 1 in an axially shiftable manner.

Another feature of the invention resides broadly in the water lance blower, the object being that the vertical spindle 6 is enclosed by a stationary protective pipe 22 with a longitudinal groove, that a threaded nut 23 with a fitting key 2 is arranged on the vertical spindle 6 with the fitting key 2 being guided in the longitudinal groove and, projecting from the groove, holding a bushing 13 which the housing 9 is located on.

Yet another feature of the invention resides in a water lance blower, the object being that the housing 9 and the accommodation 10 are made of one piece, that the fitting key 2 is T-shaped and fastened to the housing 9 with its flange 24 from the outside and that its shank is passed through the housing 9 into the threaded nut 23.

Still another feature of the invention resides broadly in the water lance blower, the object being that the vertical spindle 6 is driven by a geared motor 20.

A further feature of the invention resides broadly in the water lance blower, the object being that the vertical spindle 6 and the horizontal spindles 7; 8 are enclosed by a bellow or a spiral protective spring 14.

Another feature of the invention resides broadly in the water lance blower, the object being that the vertical spindles 7; 8 are at their ends supported in a front box 18 and in a rear box 19, that the upper spindle 7 is driven by a geared motor 17 and the lower spindle 8 is via a chain connected with the upper spindle 7 in the rear box.

Some examples of steam generators and components thereof which could be utilized in conjunction with the apparatus of the present invention are disclosed by the following U.S. Pat. No. : 4,319,358 to Berkley, entitled "Multiple Pressure Boiler With Energy Recovery System"; U.S. Pat. No. 4,074,981 to Slater, entitled "Partial Oxidation Process"; U.S. Pat. No. 4,007,019 to Slater et al., entitled "Production of Clean Synthesis or Fuel Gas".

Some examples of cleaning apparatus for cleaning heat exchange surfaces, and components thereof which could be utilized in conjunction with the apparatus of the present invention are disclosed by the following U.S. Pat. No. : 5,184,636, entitled "Cleaning Lance Device for Cleaning Pipe Bundles of Heat Exchangers"; U.S. Pat. No. 4,487,165 to Weber et al., entitled "Tube Lane Manipulator"; U.S. Pat. No. 4,137,928 to Sentell, entitled "Apparatus for Cleaning the Interior of Tubes"; and U.S. Pat. No. 4,225,362 to Sentell, entitled "Method for Cleaning the Interior of Tubes".

Some examples of systems for controlling movement of a device in a cartesian coordinate type of system, which systems could possibly be used in conjunction with the present invention are disclosed by the following U.S. Pat. No. : 4,832,902 to Kaufman et al., entitled "Refueling of Nuclear Reactor"; U.S. Pat. No. 4,514,814 to Evans, entitled "Multi-Processor Axis Control"; U.S. Pat. No. 4,509,002 to Hollis, entitled "Precision X-Y Positioner"; and U.S. Pat. No. 3,941,987 to Tack, entitled "Method and Apparatus for Numerical Control".

Some examples of cardan joints which could possibly be used in conjunction with the present invention are disclosed by the following U.S. Pat. No. : 4,487,436 to Mares and Ritter, entitled "Cardan-Type Pipe Joint with Compensation for Longitudinal Expansion"; U.S. Pat. No. 4,254,521 to Papmahl, entitled "Anchored Marine Fluid Transfer Buoy"; U.S. Pat. No. 4,097,072 to Van Heijst, entitled "Conduit with Cardan Joint"; and U.S. Pat. No. 4,083,135 to Van-Den-Brink and Wolters, entitled "Flexible Connecting Arrangement for Suction Dredgers".

Some examples of motion sensors which could be used in conjunction with the present present invention are disclosed by the following U.S. Pat. No. : 4,159,660 to Buckley et al. entitled "Biaxial Turning Machine with Means for Bidirectional Independent Tool Compensation"; U.S. Pat. No. 4,644,188 to Grib, entitled "Voltage Comparison Circuits for Motion Amplitude Regulators or the Like"; and U.S. Pat. No. 4,499,436 to Grib, entitled "Motion Amplitude Regulator with Breaking Pulse Regulation".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application Nos. P 41 42 448.4, filed on Dec. 18, 1991, and P 42 39 410.4, filed Nov. 17, 1992, having inventors Lothar Franzke, Frank-Dieter Kahle, Reinhard Sommer and Wilfried Boden, and DE-OS P 41 42 448.4 and P 42 39 410.4 and DE-PS P 41 42 448.4 and P 42 39 410.4 and International Application No. PCT/DE92/01050, filed on Dec. 9, 1992, as well as their published equivalents, and other equivalents or corresponding applications, if any, in corresponding cases in the Federal Republic of Germany and elsewhere, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A steam generator with a spray lance for cleaning contaminants off a surface of a heat exchange member of the steam generator, said steam generator comprising:

a combustion chamber for burning fuel to generate heat;

fuel supply means for supplying fuel to the combustion chamber;

a first chamber adjacent said combustion chamber for receiving heat generated by combustion from the combustion chamber;

a heat recovery chamber for containing water to be heated by heat generated by combustion;

said heat exchange member being disposed between said first chamber and said heat recovery chamber to transfer heat generated by combustion to water contained in the heat recovery chamber;

said heat exchange member having a first surface in said first chamber and a second surface in said heat recovery chamber and said heat exchange member being configured for transferring heat from said first surface to said second surface;

means for removing contaminants from said first heat exchange surface, said means for removing comprising:

said spray lance, said spray lance having a first end disposed towards said first surface for ejecting fluid under pressure against said first surface and a second end opposite said first end, said spray lance defining an axial direction between said first and second ends;

means for pivotably mounting said spray lance in a third surface in said first chamber, said third surface being substantially opposite said first surface;

means for supplying fluid under pressure to said spray lance;

means for pivoting said first end of said spray lance relative to said second end of said spray lance to move said first end of said spray lance along at least:

a first substantially linear path; and a second substantially linear path disposed angularly to said first path to define a plane of movement of said first and second paths said plane of movement being disposed angularly with respect to said axial direction of said spray lance said means for moving comprising:

first moving means for moving said first end of said spray lance along said first substantially linear path; and second moving means for moving said first moving means in said plane of movement;

said first moving means comprising:

a first substantially linear member, said first substantially linear member defining said first substantially linear path;

first guide means for being moved along said first substantially linear member, said first guide means comprising means for receiving said first end of said spray lance therein for movement of said spray lance with said first guide means; and first apparatus for moving said first guide means along said first substantially linear member; and said second moving means comprising means for moving said first substantially linear member within said plane of movement.

2. The steam generator with a spray lance according to claim 1, wherein said second moving means comprises: a second substantially linear member disposed angularly with respect to said first substantially linear member, said second substantially linear member defining said second substantially linear path;

second guide means for being moved along said second substantially linear member, said second guide means comprising means for engaging said first substantially linear member for movement of said first substantially linear member along said second substantially linear member; and second apparatus for moving said second guide means along said second substantially linear member.

3. The steam generator with a spray lance according to claim 1, wherein:

said first substantially linear member is disposed substantially perpendicularly to said second substantially linear member; and said first guide means further comprises:

a U-shaped portion having first and second arm members extending therefrom;

first sleeve means for being disposed about said first end of said spray lance, said spray lance being movable axially within said first sleeve means; and means for pivotably mounting said first sleeve means between said first and second arm members to provide a conical angle of movement for said first sleeve means.

4. The steam generator with a spray lance according to claim 3, wherein:

said first substantially linear member has a first end and a second end;

said second guide means comprises means for engaging said first substantially linear member adjacent the first end of said first substantially linear member;

said second moving means further comprises:

a third substantially linear member disposed parallel to said second substantially linear member;

third guide means for being moved along said third substantially linear member, said third guide means comprising means for engaging said first substantially linear member adjacent the second end of said first substantially linear member.

5. The steam generator with a spray lance according to claim 4, wherein:

each of said first, second and third substantially linear members correspondingly comprise first, second and third threaded spindles, said second and third threaded spindles comprising bearing means for mounting said second and third threaded spindles to said third surface in said first chamber;

each of said first, second and third guide means correspondingly comprise a threaded nut threaded onto a corresponding threaded spindle;

said means for engaging said first spindle by said second and third guide means comprise bearing means for rotatably guiding said first and second ends of said first spindle therein;

said first spindle comprises second sleeve means disposed therearound, said second sleeve means comprising a longitudinal slot disposed along said first spindle;

said nut threaded on said first spindle comprises a projection extending through said slot of said second sleeve means for maintaining said nut in a non-rotating manner on said first spindle;

said first apparatus for moving comprises a first drive means for rotating said first threaded spindle to move said corresponding nut means along said first threaded spindle;

said second apparatus for moving comprises a second drive means for rotating one of: said second and third threaded spindles; and said second apparatus for moving comprises a transmission element disposed between said second and third threaded spindles for rotating said second and third threaded spindles in synchronization with one another.

6. The steam generator with a spray lance according to claim 5, wherein:

said first guide means comprises a first housing disposed between said first and second arm members;

said first housing having first and second sides disposed adjacent said first and second arm members;

said adjacent ones of said first and second sides and first and second arm members comprise pivot means for mounting said first housing to said first and second arm members to rotate about a first axis of rotation, said first axis of rotation being substantially parallel to said first spindle means;

said first housing additionally comprises third and fourth sides disposed between and connecting said first and second sides;

said first sleeve means with said third and fourth sides comprising pivot means for mounting said first sleeve means to said third and fourth sides to rotate about a second axis of rotation, said second axis of rotation being perpendicular to said first axis of rotation; and said first guide means further comprises a second housing disposed about said second sleeve means, said projection of said corresponding threaded nut of said first spindle engaging said second housing for maintaining said second housing in a non-rotatable manner about said first spindle; and said first and second arm members being attached to said second housing.

7. The steam generator with a spray lance according to claim 6, wherein:

said first guide means comprises a single component forming said second housing and said first and second arm members;

said second housing portion of said single component has an interior portion disposed towards said second sleeve means and an exterior portion opposite to said interior portion;

said second housing portion comprises a slot therein aligned with said slot of said second sleeve means;

said projection of said nut means comprises a T-shaped key member having a first portion for being inserted through said second housing portion of said single component from the exterior thereof into engagement with said corresponding threaded nut of said first spindle, and a second portion for abutting said exterior of said second housing portion; and said first portion of said key member comprising means for fastening said key member to said corresponding threaded nut and said second portion of said key member comprises means for fastening said key member to said exterior portion of said second housing portion.

8. The steam generator with a spray lance according to claim 7, wherein:

said first and second drive means comprise first and second geared motors;

said steam generator further comprises computer processing means for operating said geared motors to rotate said first, second and third spindles to move said spray lance according to predetermined spray patterns, said predetermined spray patters comprising patterns having 90° turns;

said first, second and third spindles comprise a protective member disposed thereabout for protecting said spindles from contamination, said protective member comprises one of:

bellows; and a spiral spring;

said second and third spindles each comprise a first end and a second end;

said means for washing further comprises:

a first mounting box for rotatably mounting said first ends of said second and third spindles; and a second mounting box for rotatably mounting said second ends of said second and third spindles;

one of said first and second mounting boxes housing said transmission element between said second and third spindles;

said transmission element comprises a chain transmission disposed about said second and third spindles;

said first spindle comprises a vertical spindle;

said second spindle comprises an upper horizontal spindle and said third spindle comprises a lower horizontal spindle;

said upper spindle being driven by said geared motor, and said lower spindle being driven by said chain transmission via said second geared motor;

said means for washing further comprises a square-pyramidal shaped housing member having a base portion projecting away from said first surface of said heat exchange member, and opening outwardly towards said first surface of said heat exchange member;

said base portion of said pyramidal housing comprising a cardan joint for mounting said second end of said spray lance to said third surface of said first chamber;

said pyramidal housing comprising means for attaching said housing to said third surface of said first chamber;

said first, second and third spindles comprise sensor means for sensing movement of said first, second and third spindles;

said spray lance comprises a spray lance for ejecting liquid under pressure towards said first surface of said heat exchange member;

said first sleeve means of said first guide means has first and second ends, and at least said first and second ends of said sleeve means comprises slide bushings disposed therein and disposed about said spray lance to facilitate axial sliding of said spray lance within said sleeve means;

said first guide means further comprises a bushing disposed about said second sleeve means between said second sleeve means and said second housing portion of said single component at least adjacent ends of said second housing portion;

said second and third guide means further comprise additional housings for housing said bearing means for engaging said first spindle; and said corresponding threaded nuts of said second and third spindles comprise means for engaging said additional housings of the corresponding second and third guide means.

9. In a steam generator, a means for washing contaminants off at least a first surface of a heat exchange member, the steam generator having a combustion chamber for burning fuel to generate heat; a first chamber adjacent said combustion chamber for receiving heat generated by combustion from the combustion chamber, a heat recovery chamber for containing water to be heated by heat generated by combustion, the heat exchange member being disposed between said first chamber and said heat recovery chamber, and the first surface of the heat exchange member being disposed in said first chamber, said means for washing comprising:

nozzle means for ejecting fluid under pressure against said first surface, the nozzle means having a first end for being disposed toward the first surface of the heat exchange member and a second end disposed opposite said first end, said nozzle means defining an axial direction between said first and second ends;

means for pivotably mounting said nozzle means in the first chamber at a position substantially opposite said first surface;

means for supplying fluid under pressure to said nozzle means;

means for pivoting said first end of said nozzle means relative to said second end of said nozzle means to move said first end of said nozzle means along at least:

a first substantially linear path; and a second substantially linear path disposed angularly to said first path to define a plane of movement of said first and second paths, said plane of movement being disposed angularly with respect to said axial direction of said nozzle means;

said means for moving comprising:

first moving means for moving said first end of said nozzle means along said first substantially linear path, said first moving means comprising:

a first substantially linear member, said first substantially linear member defining said first substantially linear path;

first guide means for being moved along said first substantially linear member, said first guide means comprising means for receiving said first end of said nozzle means therein for movement of said nozzle means with said first guide means; and first apparatus for moving said first guide means along said first substantially linear member; and second moving means for moving said first substantially linear member in said plane of movement.

10. The washing means according to claim 9, wherein said first guide means further comprises:

a U-shaped portion having first and second arm members extending therefrom;

first sleeve means for being disposed about said first end of said nozzle means, said nozzle means being movable axially within said first sleeve means; and means for pivotably mounting said first sleeve means between said first and second arm members to provide a conical angle of movement for said first sleeve means.

11. The washing means according to claim 10, wherein said first substantially linear member has a first end and a second end, and said second moving means comprises:

a second substantially linear member disposed angularly with respect to said first substantially linear member, said second substantially linear member defining said second substantially linear path;

second guide means for being moved along said second substantially linear member, said second guide means comprising means for engaging said first substantially linear member adjacent the first end of said first substantially linear member for movement of said first substantially linear member along said second substantially linear member;

a third substantially linear member disposed parallel to said second substantially linear member;

third guide means for being moved along said third substantially linear member, said third guide means comprising means for engaging said first substantially linear member adjacent the second end of said first substantially linear member; and second apparatus for moving said second and third guide means along said second and third substantially linear members.

12. The washing means according to claim 11, wherein:

said first substantially linear member is disposed substantially perpendicularly to said second and third substantially linear members;

said first guide means comprises a first housing disposed between said first and second arm members;

said first housing having first and second sides disposed adjacent said first and second arm members;

said adjacent ones of said first and second sides and first and second arm members comprise pivot means for mounting said first housing to said first and second arm members to rotate about a first axis of rotation, said first axis of rotation being substantially parallel to said first spindle means;

said first housing additionally comprises third and fourth sides disposed between and connecting said first and second sides;

said first sleeve means with said third and fourth sides comprising pivot means for mounting said first sleeve means to said third and fourth sides to rotate about a second axis of rotation, said second axis of rotation being perpendicular to said first axis of rotation;

said first guide means further comprises a second housing disposed about said first spindle, said projection of said corresponding threaded nut of said first spindle engaging said second housing for maintaining said second housing in a non-rotatable manner about said first spindle; and said first and second arm members being attached to said second housing.

13. The washing means according to claim 12, wherein:

each of said first, second and third substantially linear members correspondingly comprise first, second and third threaded spindles, said second and third threaded spindles comprising bearing means for mounting said second and third threaded spindles to a second surface in said first chamber;

each of said first, second and third guide means correspondingly comprise a threaded nut threaded onto a corresponding threaded spindle;

said means for engaging said first spindle means by said second and third guide means comprise bearing means for rotatably guiding said first and second ends of said first spindle therein;

said first spindle comprises second sleeve means disposed therearound, said second sleeve means comprising a longitudinal slot disposed along said first spindle;

said nut threaded on said first spindle comprises a projection extending through said slot of said second sleeve means for maintaining said nut in a non-rotating manner on said first spindle;

said first apparatus for moving comprises a first drive means for rotating said first threaded spindle to move said corresponding nut means along said first threaded spindle;

said second apparatus for moving comprises a second drive means for rotating one of: said second and third threaded spindles; and said second apparatus for moving comprises a transmission element disposed between said second and third threaded spindles for rotating said second and third threaded spindles in synchronization with one another.

14. The washing means according to claim 13, further comprising:

a square-pyramidal shaped housing member having a base portion projecting away from said first surface of said heat exchange member, and opening outwardly towards said first surface of said heat exchange member;

said base portion of said pyramidal housing comprising a cardan joint for mounting said second end of said nozzle means to said second surface of said first chamber;

said cardan joint providing a fluid communication through said second surface of said first chamber to said means for providing fluid under pressure; and said pyramidal housing comprising means for attaching said housing to said second surface of said first chamber.

15. The washing means according to claim 14, wherein said second and third spindles each comprise a first end and a second end, and said means for washing further comprises:

a first mounting box for rotatably mounting said first ends of said second and third spindles; and a second mounting box for rotatably mounting said second ends of said second and third spindles;

one of said first and second mounting boxes houses said transmission element between said second and third spindles; and said transmission element comprises a chain transmission disposed about said second and third spindles.

16. The washing means according to claim 15, wherein:

said first guide means comprises a single component forming said second housing and said first and second arm members;

said second housing portion of said single component has an interior portion disposed towards said second sleeve means and an exterior portion opposite to said interior portion;

said second housing portion comprises a slot therein aligned with said slot of said second sleeve means;

said projection of said nut means comprises a T-shaped key member having a first portion for being inserted through said second housing portion of said single component from the exterior thereof into engagement with said corresponding threaded nut of said first spindle, and a second portion for abutting said exterior of said second housing portion; and said first portion of said key member comprising means for fastening said key member to said corresponding threaded nut and said second portion of said key member comprises means for fastening said key member to said exterior portion of said second housing portion.

17. The washing means according to claim 16, wherein:

said first and second drive means comprise first and second geared motors;

said steam generator further comprises computer processing means for operating said geared motors to rotate said first, second and third spindles to move said nozzle means according to predetermined spray patterns, said predetermined spray patters comprising patterns having 90° turns;

said first, second and third spindles comprise a protective member disposed thereabout for protecting said spindles from contamination, said protective member comprises one of:

bellows; and a spiral spring;

said first spindle comprises a vertical spindle;

said second spindle comprises an upper horizontal spindle and said third spindle comprises a lower horizontal spindle;

said upper spindle being driven by said geared motor, and said lower spindle being driven by said chain transmission via said second geared motor;

said first, second and third spindles comprise sensor means for sensing movement of said first, second and third spindles;

said nozzle means comprises a nozzle means for ejecting liquid under pressure towards said first surface of said heat exchange member;

said first sleeve means of said first guide means has first and second ends, and at least said first and second ends of said sleeve means comprises slide bushings disposed therein and disposed about said nozzle means to facilitate axial sliding of said nozzle means within said first sleeve means;

said first guide means further comprises a bushing disposed about said second sleeve means between said second sleeve means and said second housing portion of said single component at least adjacent ends of said second housing portion;

said second and third guide means further comprise additional housings for housing said bearing means for engaging said first spindle; and said corresponding threaded nuts of said second and third spindles comprise means for engaging said additional housings of the corresponding second and third guide means.

* * * * *

UNITED STATES PATENT AND TRADEMARK OFFICE

CERTIFICATE OF CORRECTION

PATENT NO. : 5,503,115

DATED : April 2, 1996

INVENTOR(S) : Lothar FRANZKE, Frank-Dieter KAHLE, Reinhard SOMMER and Wilfried BODEN It is certified that error appears in the above-indentified patent and that said Letters Patent is hereby corrected as shown below:

In column 12, line 39, Claim 3, after 'claim', delete "1," and insert --2,--.

In column 17, line 17, Claim 13, after 'spindle' delete "means".

Signed and Sealed this

Thirty-first Day of December, 1996

*Attest:*

Bruce Lehman

BRUCE LEHMAN

*Attesting Officer*

*Commissioner of Patents and Trademarks*